US007934864B2

(12) United States Patent
Heusser et al.

(10) Patent No.: US 7,934,864 B2
(45) Date of Patent: May 3, 2011

(54) MULTICOMPONENT FOIL-TYPE CONTAINER

(75) Inventors: Rolf Heusser, Winterthur (CH); Markus Gasser, Pfäffikon (CH); Andreas Staub, Winterthur (CH)

(73) Assignee: Sulzer Mixpac AG, Haag (CH)

( * ) Notice: Subject to any disclaimer, the term of this patent is extended or adjusted under 35 U.S.C. 154(b) by 977 days.

(21) Appl. No.: 11/813,133

(22) PCT Filed: Dec. 24, 2005

(86) PCT No.: PCT/EP2005/014025

§ 371 (c)(1), (2), (4) Date: Jun. 29, 2007

(87) PCT Pub. No.: WO2006/079413

PCT Pub. Date: Aug. 3, 2006

(65) Prior Publication Data

US 2008/0123465 A1 May 29, 2008

(30) Foreign Application Priority Data

Jan. 26, 2005 (DE) ..... 20 2005 001 203 U

(51) Int. Cl.
*B01F 15/02* (2006.01)
*B01F 5/06* (2006.01)
*B65D 25/08* (2006.01)

(52) U.S. Cl. ..... 366/130; 366/162.3; 366/189; 366/336; 206/222

(58) Field of Classification Search ..... 366/130, 366/336–340, 162.3, 184, 189; 206/219, 206/222

See application file for complete search history.

(56) References Cited

U.S. PATENT DOCUMENTS 3,736,933 A * 6/1973 Szabo ..... 604/200

(Continued)

FOREIGN PATENT DOCUMENTS

DE 199 62 436 A1 7/2001

(Continued)

OTHER PUBLICATIONS

International Search Report PCT/EP2005/014025, 5 pages.

(Continued)

*Primary Examiner* — Tony G Soohoo

(74) *Attorney, Agent, or Firm* — Martin Fleit; Paul D. Bianco; Fleit Gibbons Gutman Bongini & Bianco PL

(57) ABSTRACT

The invention relates to a multicomponent foil-type container comprising a first chamber (5) for accommodating a first component, at least one second chamber (5') for accommodating a second component, a discharge duct (6) that can be connected to said chambers (5, 5'), deflection elements (11) for mixing the components within the discharge duct (6), and a seal (12; 12'; 21; 25, 25'; 36, 36') which prevents the components from being mixed before being used and can be opened for discharging the components. The deflection elements (11) of the inventive multicomponent foil-type container are disposed on a separate mixing element (9) that is located in the discharge duct (6) such that the multicomponent foil-type container is easy to produce while allowing different components to be mixed in a particularly effectively manner. The invention further relates to a device for squeezing a multicomponent foil-type container in a particularly effective fashion. The disclosed squeezing device is provided with a holding element (61; 77) for accommodating a multicomponent foil-type container. At least one leg (68, 69; 88) that can be moved towards the chambers (5, 5') of the multicomponent foil-type container in order to squeeze the multicomponent foil-type container is hingedly connected to the end of the holding element (61; 77) which faces the rear end of an inserted multicomponent foil-type container, resulting in the components being effectively mixed.

39 Claims, 16 Drawing Sheets

U.S. PATENT DOCUMENTS

| | | | | |
|---|---|---|---|---|
| 3,799,742 | A * | 3/1974 | Coleman | 422/61 |
| 4,340,154 | A * | 7/1982 | VanManen | 222/94 |
| 4,676,657 | A * | 6/1987 | Botrie | 366/181.5 |
| 4,952,068 | A | 8/1990 | Flint | |
| 5,242,082 | A * | 9/1993 | Giannuzzi | 222/82 |
| 5,314,412 | A * | 5/1994 | Rex | 604/191 |
| 5,401,169 | A * | 3/1995 | Fleisher et al. | 433/90 |
| 5,425,475 | A | 6/1995 | Clark | |
| 5,683,013 | A | 11/1997 | Morrison | |
| 5,697,524 | A * | 12/1997 | Sedlmeier | 222/82 |
| 6,561,232 | B1 * | 5/2003 | Frutin | 141/9 |
| 6,669,055 | B1 | 12/2003 | Coleman et al. | |
| 6,705,756 | B2 | 3/2004 | Botrie et al. | |
| 7,192,179 | B2 * | 3/2007 | Angeletta | 366/130 |
| 2002/0122685 | A1 | 9/2002 | Lee et al. | |
| 2003/0075561 | A1 | 4/2003 | Pieri | |
| 2003/0187387 | A1 * | 10/2003 | Wirt et al. | 604/82 |
| 2005/0007871 | A1 * | 1/2005 | Angeletta | 366/130 |

FOREIGN PATENT DOCUMENTS

| | | | |
|---|---|---|---|
| DE | 102 42 472 | A1 | 3/2003 |
| DE | 101 56 075 | A1 | 6/2003 |
| DE | 101 58 651 | A1 | 6/2003 |
| GB | 2 255 596 | A | 11/1992 |
| GB | 2 322 114 | A | 8/1998 |
| WO | WO 00/09415 | | 2/2000 |
| WO | WO 02/22466 | A1 | 3/2002 |

OTHER PUBLICATIONS

International Preliminary Report on Patentability PCT/EP2005/014025, May 2007, 13 pages.

English Translation of International Preliminary Report on Patentability PCT/EP2005/014025, 4 pages.

* cited by examiner

MULTICOMPONENT FOIL-TYPE CONTAINER

FIELD OF THE INVENTION

The invention relates to a multicomponent foil type container. The invention further relates to a container arrangement with several such multicomponent foil type containers and also to a squeezing device for a multicomponent foil type container.

BACKGROUND OF THE INVENTION

A multicomponent foil type container of this class is known from U.S. Pat. No. 4,952,068. There the multicomponent foil type container is formed by two relatively thin and flexible plastic films, which border a first and a second chamber for accommodating the two different components of a two-component adhesive. Both chambers have outlet openings in a mixing area, wherein the components are held back in an unmixed state by separating films in the chambers before use. For squeezing out the components, the container is pressed together in the area of the chambers, so that the separating films break open and the two components are led into the mixing area. Deflection elements, by means of which the two components are mixed with each other and which are formed on the container films, are arranged in the mixing area. A discharge area with an outlet opening for the component discharge connects to the mixing area. Due to the deflection elements formed on the container films, however, the possible constructions of the mixing structures are limited, so that a relatively large mixing volume is required for achieving effective mixing. In addition, due to the limited embodiments of such a mixer, very long flow paths are required for the components to be mixed, in order to achieve adequate mixing, which results in high squeezing resistance. In addition, the deflection elements are tailored to certain components and fields of use and cannot be modified without additional means.

The problem of the present invention is to specify a multicomponent foil type container and a container arrangement of the type named above, which can be produced easily and which also allow a particularly effective mixing of different components. Furthermore, the invention should specify a squeezing device for the multicomponent foil type container, which allows effective mixing of the components.

SUMMARY OF THE INVENTION

This problem is solved by a multicomponent foil type container with the features of Claim 1, a container arrangement with the features of Claim 31, and also by a squeezing device with the features of Claim 33. Advantageous constructions and preferred improvements of the invention are specified in the subordinate claims.

For the multicomponent foil type container according to the invention, significantly more complex deflection elements and mixing structures can be realized by the separate mixing element, whereby particularly efficient mixing is allowed. The seal of the chambers of the multicomponent foil type container can be opened easily by the elongated end of the mixing element facing the chambers and the one or more opening pins arranged on this mixing element for opening the one or more seals. In comparison with conventional multicomponent containers of this type, the components need not be pre-mixed by squeezing them back and forth several times in order to achieve good mixing. The separate mixing element allows a particularly effective construction and arrangement of the deflection element, whereby the mixing volume is also reduced. The short flow paths in the mixer and the compact mixer structure allow easy squeezing of the components. The handling of the multicomponent foil type container is extremely simple and requires no complicated preparations. The container merely must be pressed together in the area of the two chambers by hand, whereby the two components are forced through the mixing element and mixed there without a great expenditure of force. Due to the separate mixing element, the multicomponent foil type container can also be adapted relatively easily to different requirements and components. According to the type and properties of the components, a suitable mixer can also be selected without large production-specific changes either during production or also just before use.

In a particularly advantageous construction, the chambers are constructed in two half-shells, which are produced from a flexible but nevertheless dimensionally stable material. The two half-shells can be filled easily and then assembled together. The dimensionally stable material can prevent the chambers from bulging out during the pressing process, so that the entire applied pressure is available for pressing the components out of the chambers into the discharge duct.

For a simple construction in terms of production, the discharge duct is formed by two groove-shaped indentations in the two half-shells. The chambers for storing the components, however, can also be arranged in a separate storage part and the discharge duct can be arranged in a discharge tube that can be attached to the storage part. In this way, discharge tubes with different mixing elements can be provided for different components.

The seal for preventing mixing of the components before use can be formed by one or more separating films arranged between the two chambers. The seal, however, can also be formed by separating crosspieces or separating walls between the chambers and the discharge duct.

For squeezing out and mixing the components, the seal can be destroyed or opened by means of pressure from the outside or separate opening elements. The opening elements can be constructed, e.g., as opening pins, which are arranged on the half-shells and/or the mixing element and/or the discharge tube.

For other preferred embodiments, the opening, pins can also be arranged on the attachable discharge tube or on the half-shells.

In another embodiment, the mixing element is arranged so that it is movable in the discharge duct in the longitudinal direction of this duct, in order to be able to open the seal through the movement of the mixing element in the direction of the chambers.

BRIEF DESCRIPTION OF THE DRAWINGS

Additional details and advantages of the invention emerge from the following description of preferred embodiments with reference to the drawings. Shown are.

DETAILED DESCRIPTION OF THE INVENTION

Figure 1:
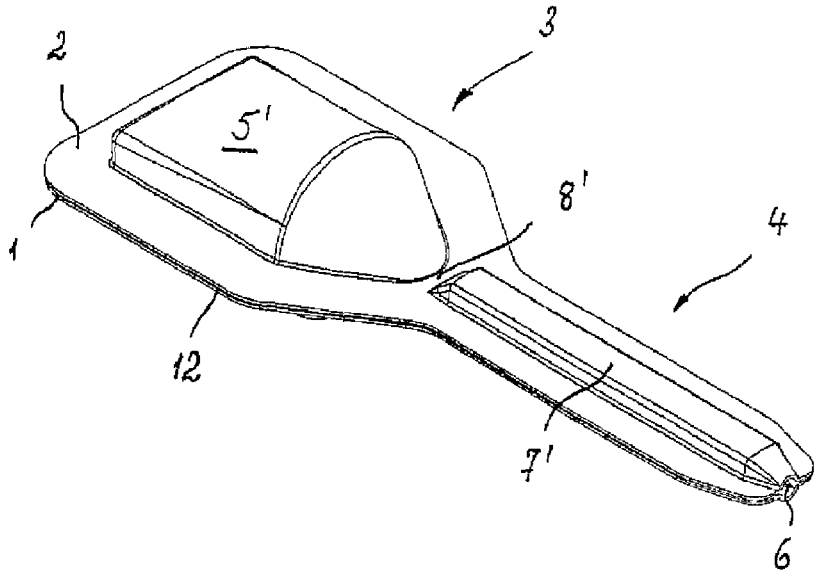
FIG. 1, a first embodiment of a multicomponent foil type container.
Figure 2:
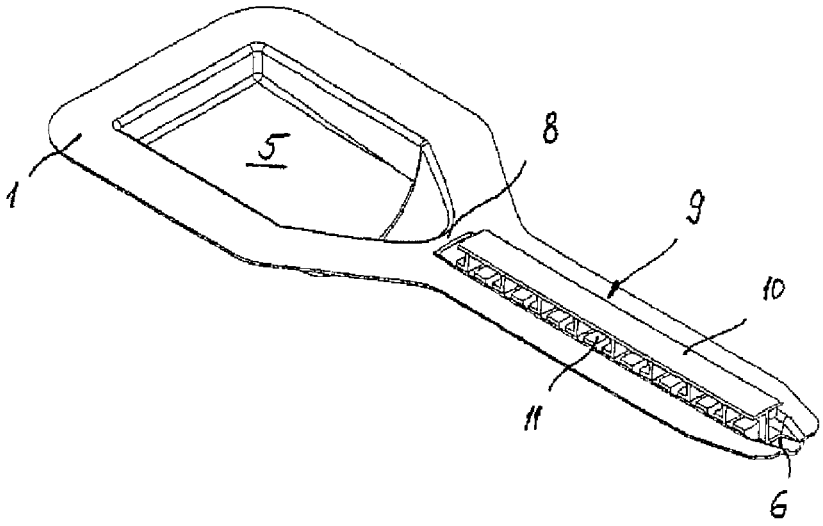
FIG. 2, a half-shell of the multicomponent foil type container shown in FIG. 1 with a mixing element.

The multicomponent foil type container shown in FIG. 1 has a lower half-shell 1 shown separately in FIG. 2 and also an identically shaped upper half-shell 2, which is produced from a dimensionally stable plastic film through a deep-drawing or thermo-forming method and which are tightly connected to each other through a welding or adhesion method. The multicomponent foil type container is divided in terms of function into a storage area 3 for the accommodation and sealed storage of two components, for example, a two-component adhesive, and a common mixing area 4, in which the two components are mixed before discharge. In the storage area 3 of the multicomponent foil type container there are two chambers 5 and 5', which are formed by bulges in the respective half-shells 1 and 2 and which are separated from each other by a separating film 12. The mixing area 4 contains a discharge duct 6, which is open at the front end and which is formed by groove-shaped indentations 7 and 7' in the two half-shells 1 and 2. The two groove-shaped indentations 7 and 7' are separated from the chambers 5 and 5' by separating crosspieces 8 and 8', respectively, and are shaped such that the discharge duct 6 bounded by it has a square or rectangular cross section over nearly the entire length. Only at the front end are the indentations 7 and 7' shaped so that they form a short discharge nozzle with a circular round discharge opening. A mixing element 9 shown in FIG. 2 is arranged in the discharge duct 6.

In FIG. 2, only the lower of the two identically constructed half-shells are shown. As emerges from FIG. 2, the chamber 5 is separated from the groove-shaped recess 7 by the separating crosspiece 8. The mixing element 9 produced from a dimensionally stable plastic, e.g., in an injection-molding method, is inserted into the groove-shaped recess 7. The mixing element 9 shown here has a base body 10 with angled crosspieces 11 formed on this body and openings. The crosspieces 11 are angled in different directions, so that a particularly effective deflection and mixing of the components is produced. The mixing element 9 can also have a different construction according to the purpose of the application or use. Thus, the mixing element, e.g., can also be round or conical and can have a spiral-shaped mixing structure.

The separating film 12, which is indicated only schematically in FIG. 1 and which is attached to one or also to both of the previously filled half-shells 1 and 2 before filling the two chambers 5 and 5', is arranged between the two half-shells 1 and 2 before these are then placed one on top of the other and tightly connected to each other. The separating film or films 12 form a seal, by means of which it is guaranteed that the two components located in the chambers 5 and 5' do not mix with each other before use.

To discharge the two components from the multicomponent foil type container, the two half-shells 1 and 2 are pressed together by hand in the area of the chambers 5 and 5'. The separating film 12 is constructed such that it is lifted from the chambers 5 and 5' by the pressure generated within the chambers 5 and 5' when the half-shells 1 and 2 are pressed together in the area of the separating crosspieces 8 and 8' of the half-shells 1 and 2 and allows an outlet of the components from the chambers 5 and 5'. The separating crosspieces 8 and 8' are also designed so that they are pressed apart from each other at a predetermined point by the emerging components and form a passage from the chambers 5 and 5' to the discharge duct 6. In this way, the components can be led into the discharge duct 6 and through the mixing element 9 to the discharge opening. Here, the two components are mixed with each other and the adhesive or the like can be discharged immediately at a desired position.

Figure 3:
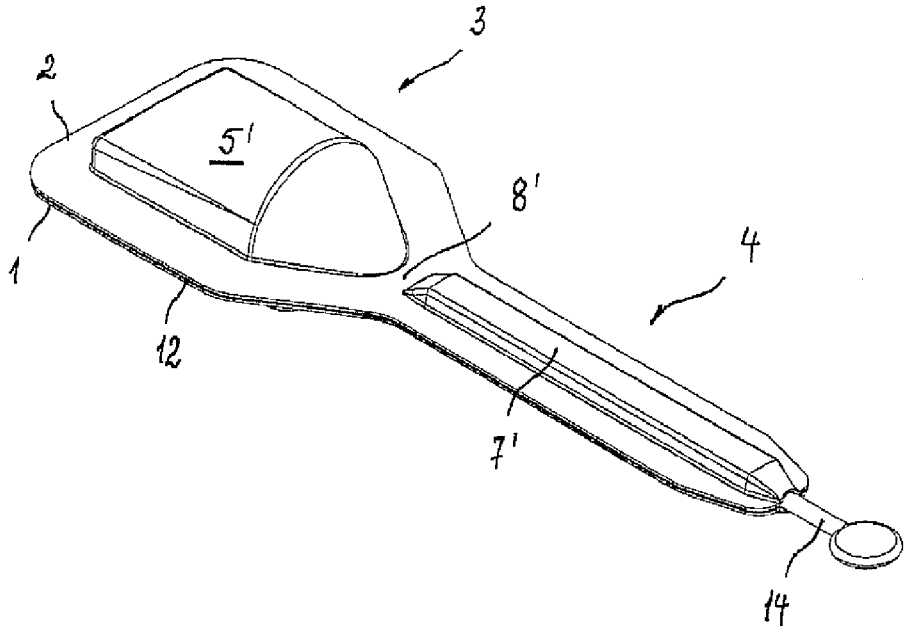
FIG. 3, a second embodiment of a multicomponent foil type container.
Figure 4:
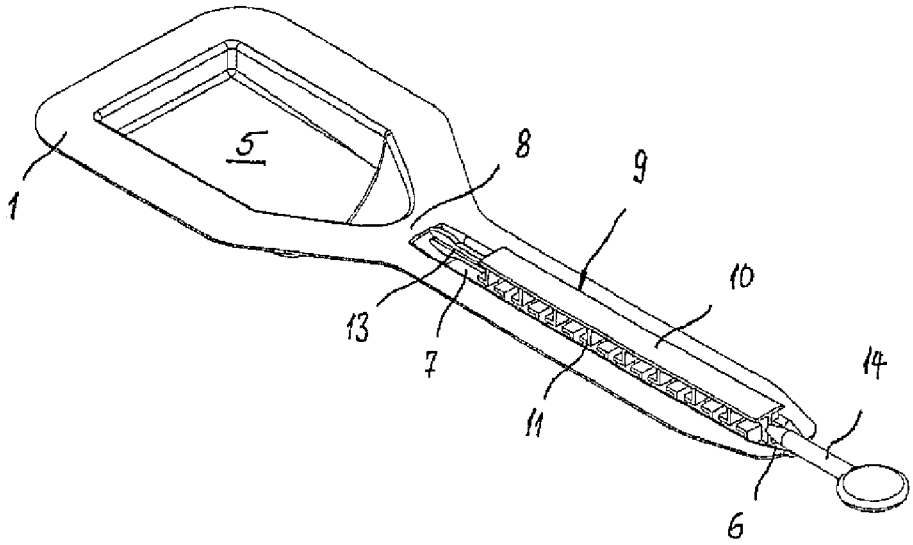
FIG. 4, a half-shell of the multicomponent foil type container shown in FIG. 3 with a mixing element.

The second embodiment of a multicomponent foil type container shown schematically in FIGS. 3 and 4 differs from the first embodiment only by the construction of the mixing element 9. Corresponding parts are therefore also provided with the same reference symbols. In the construction shown here, the mixing element 9 is displaceably arranged in the longitudinal direction within the discharge duct 6 and a shaped opening pin 13 with two points on its interior end facing the chambers 5 and 5'. A plunger 14 projecting outwards from the discharge duct 6 is formed at the other end of the mixing element 9.

To connect the chambers 5 and 5' to the discharge duct 6, the mixing element 9 is pressed in the direction of chambers 5 and 5' by hand with the aid of the plunger 14, so that the tips of the opening pin 13 are pushed between the separating crosspieces 8, 8' of the two half-shells 1 and 2 and in this way the separating crosspieces 8 and 8' are spread apart from each other for forming a passage. In addition, the separating film or films 12 are lifted from the half-shells 1 and 2 by the tips of the opening pin 13, so that the components can be pressed from the chambers 5 and 5' into the discharge duct 6 and towards the discharge opening by the mixing element 9. So that the mixed components can also be discharged through the discharge opening the plunger 14 can be rotated about its longitudinal axis after pushing it into the mixing element 9 and pulling it back into its original position, and in this way it is detached from the mixing element 9.

Figure 5:
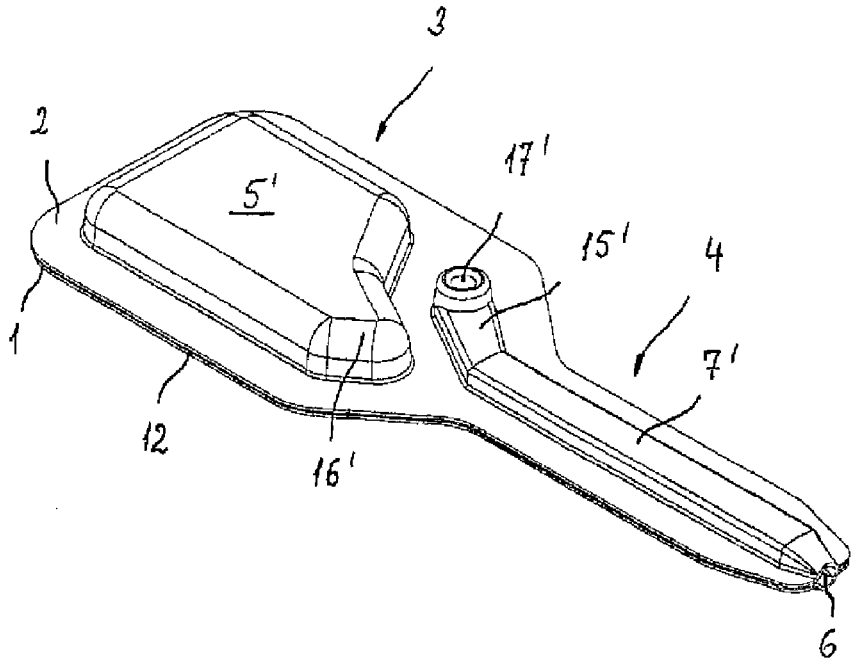
FIG. 5, a third embodiment of a multicomponent foil type container.
Figure 6:
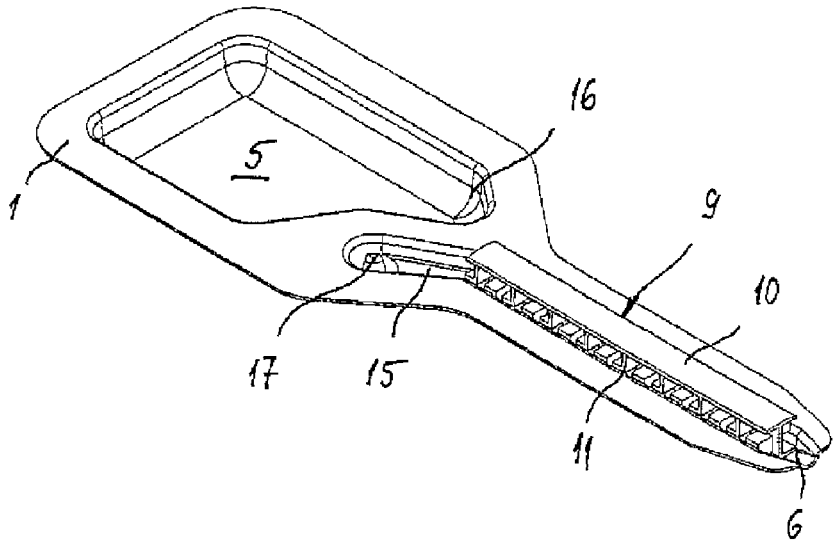
FIG. 6, a half-shell of the multicomponent foil type container shown in FIG. 5 with a mixing element.

The third embodiment shown in FIGS. 5 and 6 differs from the previously mentioned constructions essentially in that the groove-shaped indentations 7 and 7' have inclined parts 15 and 15', respectively, elongated on the chamber-side end and arranged next to an area 16 and 16' of the chambers 5 and 5', respectively, elongated towards the front. As follows from FIG. 6, the inclined part 15 of the indentation 7 and the chamber 5 are arranged one next to the other with its elongated area 16 so that the inclined parts 15 and 15' of one hall-shell each overlap the elongated areas 16 and 16' of the other half-shell when the identical half-shells 1 and 2 are placed one on top of the other. Opening pins 17 and 17', which can be pressed from the outside, which project inwards, and which can be made to pierce through the separating film or films 12 arranged between the half-shells 1 and 2 by hand without damaging the outer skin of the container, are arranged on the two inclined parts 15 and 15'.

Figure 7:
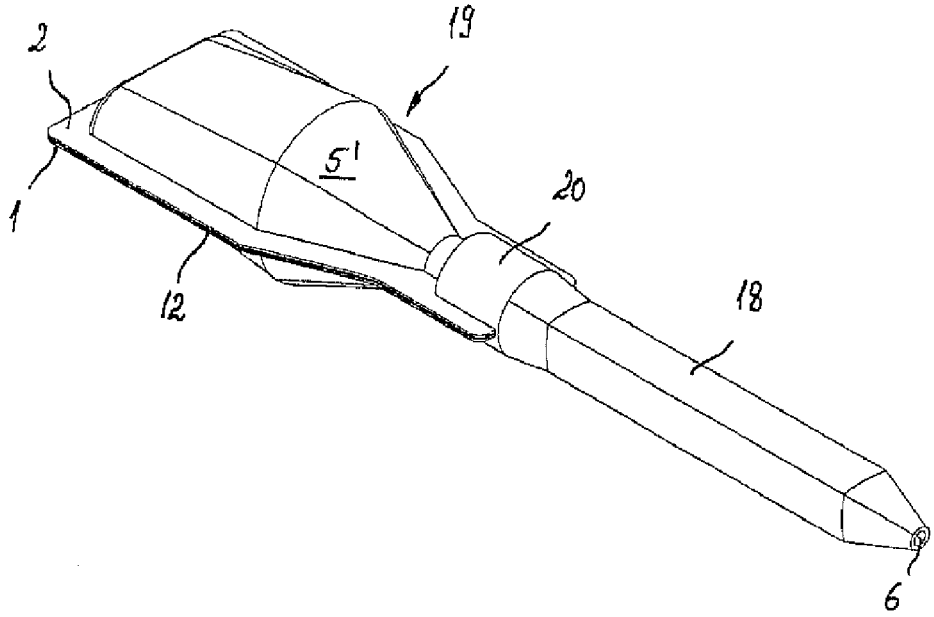
FIG. 7, a fourth embodiment of a multicomponent foil type container.
Figure 8:
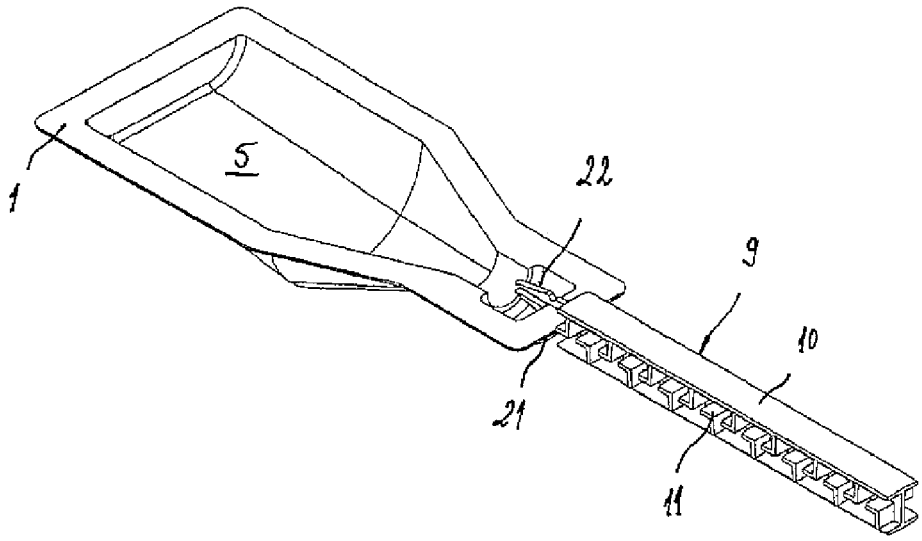
FIG. 8, a half-shell of the multicomponent foil type container shown in FIG. 7 with a mixing element.

In the fourth embodiment shown in FIGS. 7 and 8, a separate discharge tube 18 with the discharge duct 6 arranged therein is provided. The discharge tube 18 can be set on a separate storage part 19 of the multicomponent foil type container at this point. The storage part 19 is here composed of two identical half-shells 1 and 2, in which the chambers 5 and 5' formed by bulges are located. The two chambers 5 and 5' are also here filled with different components. The seal is realized here by a separating film 12 arranged between the half-shells 1 and 2 and by a front separating wall 21 of the half-shells 1 and 2. The chambers 5 and 5' are separated from the discharge duct 6 of the discharge tube 18 before use by the front separating walls 21 of the two half-shells 1 and 2. The discharge tube 18 can be connected to the storage part 19 sealed from the outside by means of a sleeve-shaped attachment part 20. To connect the chambers 5 and 5' to the discharge duct 6, the separating walls 21 of the half-shells 1 and 2 must be pierced. For this purpose, an opening pin 22 with two points is formed on the chamber-side end of the mixing element 9 in the discharge tube 18. The front separating walls 21 of the storage part 19 are pierced by the two tips of the opening pin 22 when the discharge tube 18 is attached, so that the components can be led into the discharge duct 6 of the discharge tube 18.

Figure 9:
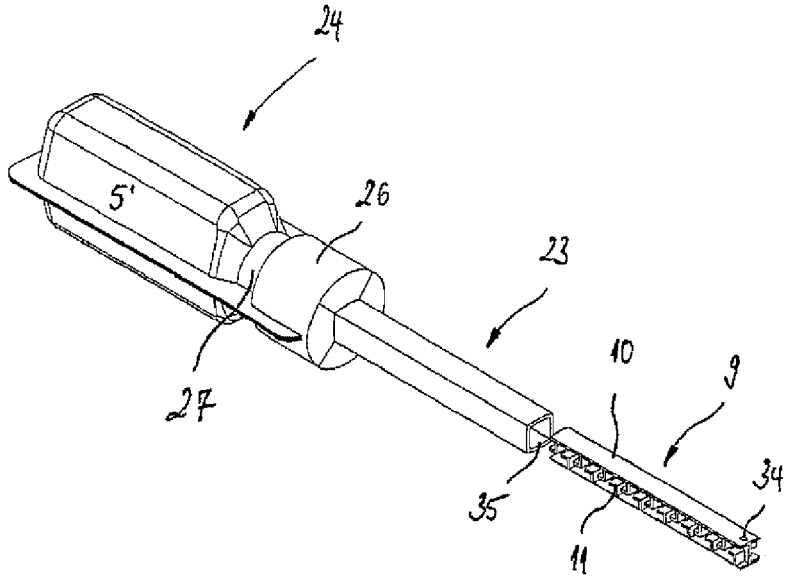
FIG. 9, a fifth embodiment of a multicomponent foil type container.
Figure 10:
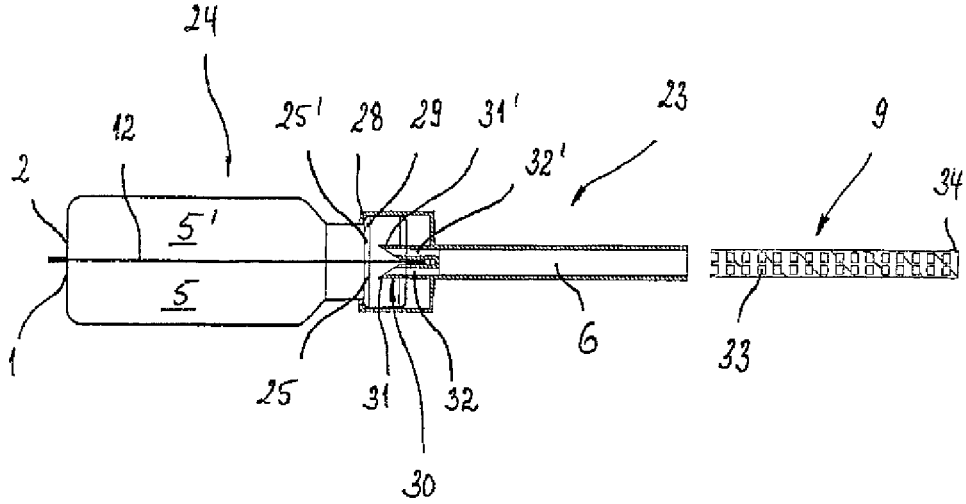
FIG. 10, a side view of the multicomponent foil type container from FIG. 9 partially in section.

In the fifth embodiment shown in FIGS. 9 and 10, a discharge tube 23 is attached to a storage part 24 displaceable in the longitudinal direction. The storage part 24 is composed, in turn, from two identical half-shells 1 and 2, in which the chambers 5 and 5' formed from indentations are constructed. Here, the two chambers 5 and 5' are also separated from each other by a separating film or films 12 arranged between the half-shells 1 and 2. Within the half-shells 1 and 2 there are separating walls 25 and 25', which prevent the discharge of the components into the discharge duct 6 before use. The discharge tube 23 is constructed for this configuration such that the mixing element 9 can be inserted from the discharge opening into the discharge duct 6.

As shown in FIG. 10, the discharge tube 23 is attached by means of a hollow cylindrical attachment piece 26 onto a throat 27 of the storage pan 24 with a round cross section displaceable in the longitudinal direction. The axial displacement of the discharge tube 23 is limited towards the front by an annular crosspiece 28 projecting inwards on the attachment piece 26 and a corresponding shoulder 29 on the throat 27. The discharge tube 23 has an opening pin 30 with two separate points 31 and 31' arranged within the attachment piece 26 for piercing the two separating walls 25 and 25'. In the two points 31 and 31' there are passage channels 32 and 32' for the two components. In FIG. 10, the openings 33 can also be seen in the mixing element 9.

By pushing the discharge tube 23 in the direction of the chambers 5 and 5', the points 31 and 31' of the opening pin 30 pierce the separating walls 25 and 25' of the two half-shells 1 and 2, whereby the components can each be led through the corresponding passage channel 32 and 32', respectively, into the mixing element 9. The discharge tube 23 can be displaced by attaching the mixing element 9. To guarantee a secure seating of the mixing element 9 in the discharge tube 23 during the squeezing of the container, the mixing element 9 has catch tabs 34 or the like at its right end in FIG. 10 for engaging in corresponding catch openings or catch grooves 35 on the discharge tube 23. This catch connection prevents the mixing element 9 from being pressed from the discharge tube 23 by the resulting pressure when the components are squeezed out. The catch connection can also be provided at different suitable position. Catch connection or clamping means that are different from those shown here can also be used similarly.

Figure 11:
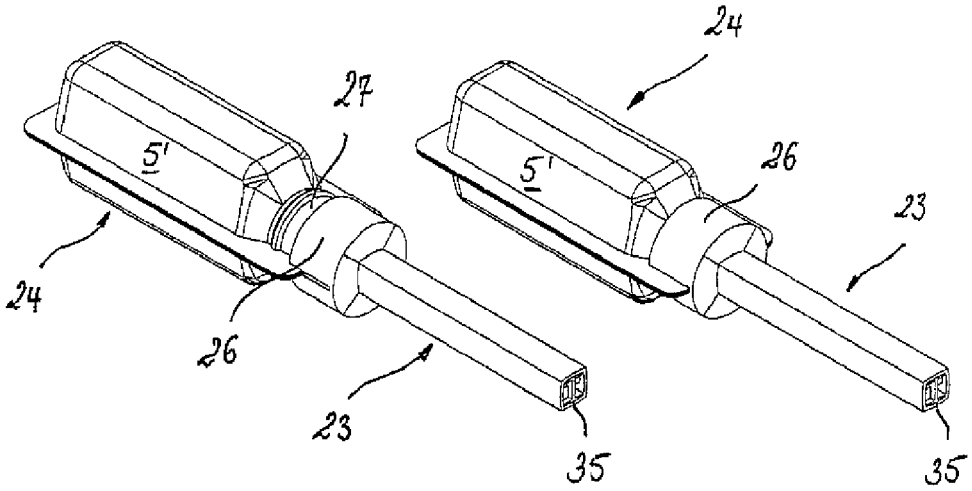
FIG. 11, a sixth embodiment of a multicomponent foil type container.
Figure 12:
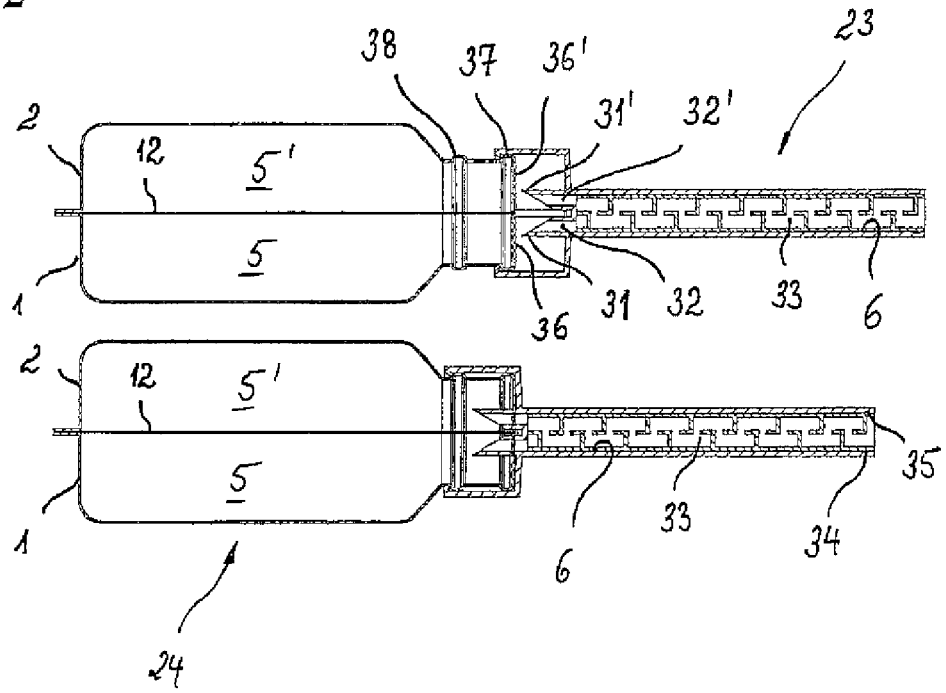
FIG. 12, a side view of the multicomponent foil type container from FIG. 11 partially in section.

The sixth embodiment shown schematically in FIGS. 11 and 12 for a multicomponent foil type container differs from the fifth embodiment only by the construction of the throat 27 and in that the discharge tube 23 is first attached to the storage part 24 before the container is used. Corresponding parts are therefore also provided with the same reference symbols. The container is shown in FIG. 1 at the left and in FIG. 12 at the top with the attached discharge tube 23 in a first position before the seal is punctured, while a second position after the puncturing is shown in FIG. 11 at the right and in FIG. 12 at the bottom.

The round cross-sectional throat 27 of the storage part 24 has two shoulders 37 and 38, which are offset in the axial direction and which project outwards and which can surround the inward projecting annular crosspiece 28 on the attachment piece 26. In contrast to the fifth embodiment, here separating walls 36 and 36' are arranged on the front end of the throat 27 for separating the chambers 5 and 5' from the discharge duct 6. When attached, the first shoulder 37 holds the attachment piece 26 in a first position, in which the separating walls 36 and 36' have not yet been pierced. To be able to pierce the separating walls 36 and 36' after placing the attachment piece 26, the attachment piece 26 is displaceable in the direction of the chambers 5 and 5' on the throat 27, wherein the first shoulder 37 prevents undesired pulling of the attachment piece 26 during the piercing. To hold the attachment piece 26 reliably in the position shown in FIG. 11 at the right and in FIG. 12 at the bottom during the squeezing out of the components, the annular crosspiece 28 is pushed by means of the second shoulder 38.

Figure 13:
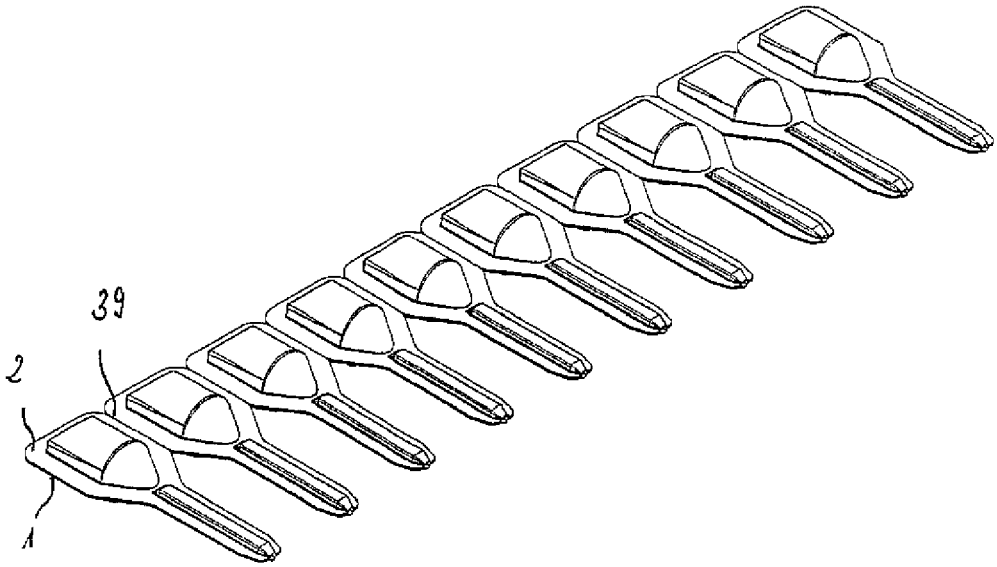
FIG. 13, a container arrangement with several multicomponent foil type containers shown in FIG. 1 and FIG. 14, a container arrangement with several multicomponent foil type containers shown in FIG. 3.
Figure 14:
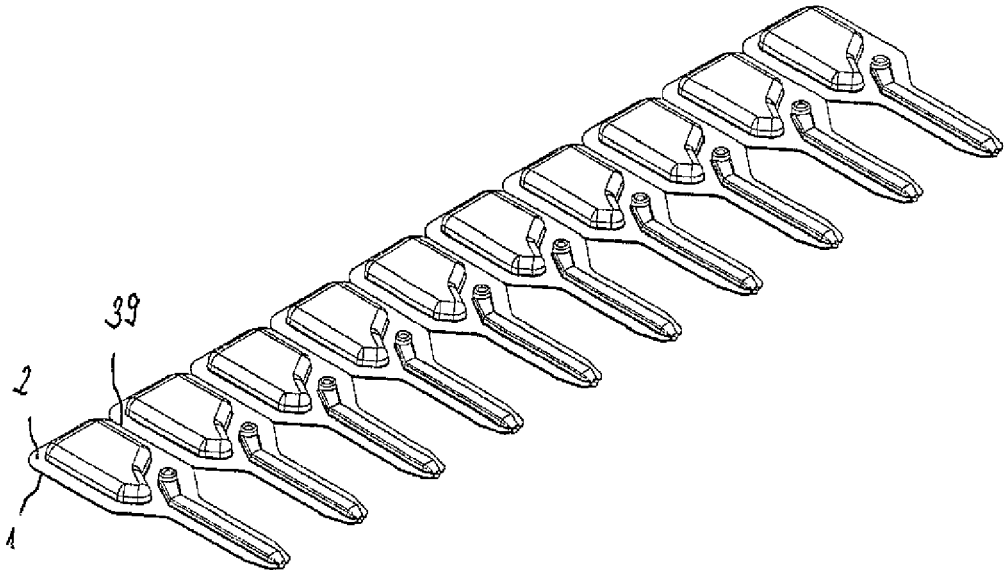

In the two FIGS. 13 and 14, holder arrangements with several multicomponent foil type containers according to the first two embodiments are shown. The individual multicomponent foil type containers are connected to each other by means of connection points 39 at the side edges of their respective storage areas 3, wherein the connection points 39 are constructed as desired rupture points, in order to be able to separate the individual containers from each other easily and without damage before use.

In the embodiments shown here, the two chambers 5 and 5' each have the same volume, so that a mixing ratio of the components of 1:1 is generated when the two chambers 5 and 5' are squeezed. By changing the chamber sizes, any mixing ratio can be achieved. For example, if the chamber 5 has only half the volume of the chamber 5', then a mixing ratio of 1:2 can be achieved.

Preferably, the chambers contain a volume from 0.5 to 10 ml. For larger quantities, the chambers can preferably have an elongated shape with a smaller height than in the previously described embodiments. Then a rod-shaped squeezing device that can rotate perpendicular to the area extent of the container can be arranged at the end of the multicomponent foil type container facing away from the discharge opening, in order to be able to roll up the essentially tubular container from the end of the container facing away from the discharge opening, and in this way achieve the most uniform possible squeezing process of the components through the discharge duct and the mixing element arranged therein.

Figure 15:
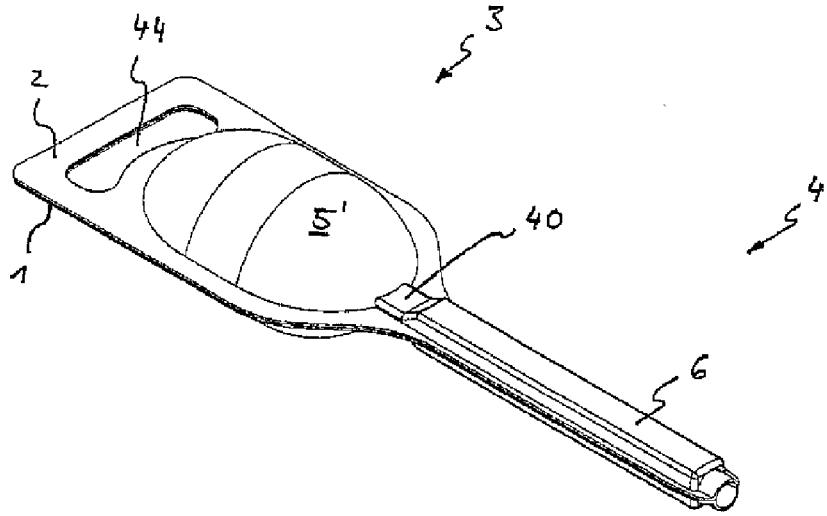
FIG. 15, a sixth embodiment of a multicomponent foil type container.
Figure 16:
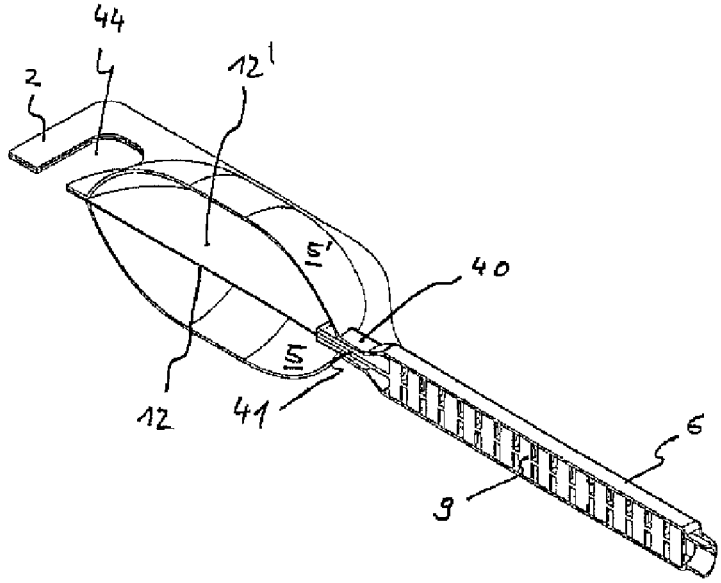
FIG. 16, a longitudinal section through the multicomponent foil type container with a mixing element from FIG. 15.
Figure 17:
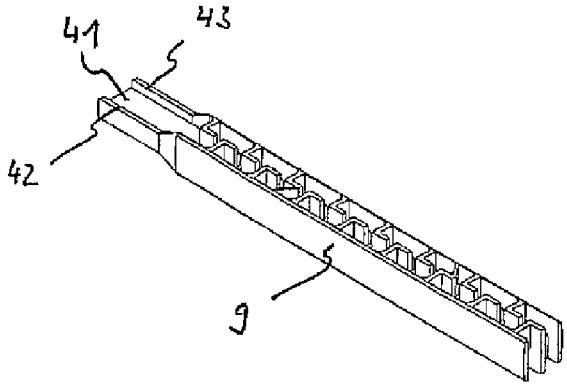
FIG. 17, a mixing element for the multicomponent foil type container from FIG. 15.
Figure 18:
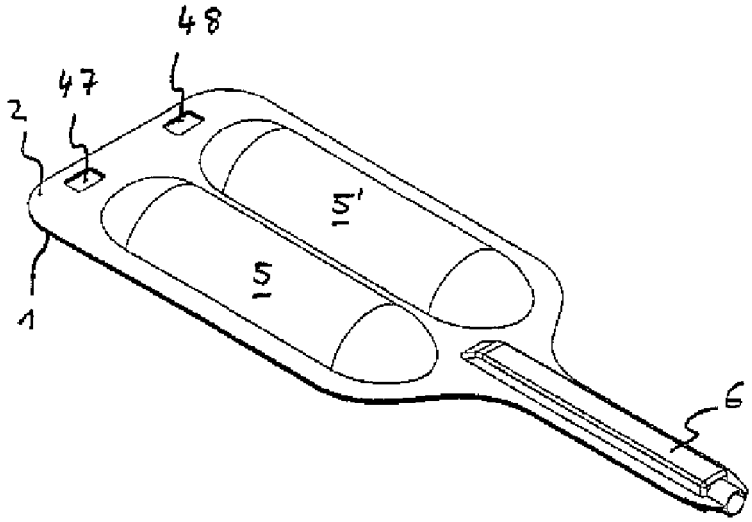
FIG. 18, an eighth embodiment of a multicomponent foil type container.
Figure 19:
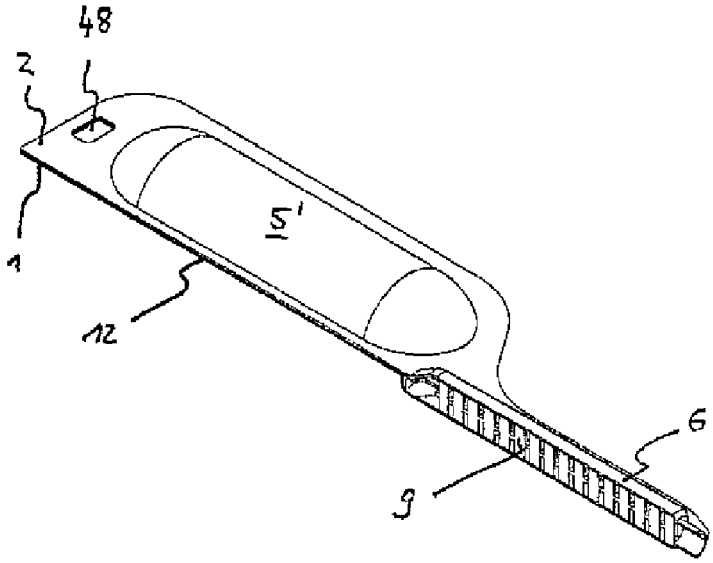
FIG. 19, a longitudinal section through the multicomponent foil type container with a mixing element from FIG. 18.

The additional multicomponent foil type container shown schematically in FIGS. 15 to 17 differs from the construction shown in FIGS. 1 and 2 essentially in that a connection channel 40, through which a guide channel 41 of the mixing element 9 reaches into the chambers 5 and 5', is formed between the discharge duct 6 and the chambers 5 and 5'. Both chambers 5 and 5' are each sealed by its own separating film 12 and 12', respectively, which are adapted on the output side to the shape of the guide channel 41. For opening the separating films 12 and 12', the discharge duct 6 is bent up and down in the area of the connection channel 40, so that the rear, elongated end of the mixing element 9 pierces the separating films 12 and 12', respectively, with the crosspieces 42 and 43 used as opening pins. By pressing the chambers 5 and 5', the components can then be led via the connection channel 40 into the discharge duct 6, wherein the guide channel 41 provides that the components flow without large pressure loss into the mixing element 9, where they are mixed. The multicomponent foil type container also has at its rear end an opening 44, through which it can be fixed in a squeezing device explained below in more detail.

An additional construction of a multicomponent foil type container shown schematically in FIGS. 18 to 22 differs from the preceding constructions primarily in that the two chambers 5 and 5' are formed one next to the other in the upper second half-shell 2 and are sealed by a single separating film 12. Therefore, the discharge duct 6 also has two connection channels 45 and 46 on its end facing the chambers 5 and 5', in order to be able to guide the components from the respective chamber 5 or 5' into the discharge duct 6. At its rear end, the multicomponent foil type container has two openings 47 and 48, by which means it can be fixed in a squeezing device (to be explained below in more detail).

Figure 20:
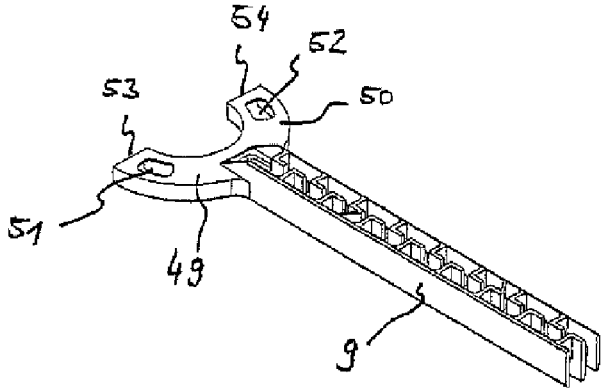
FIG. 20, a mixing element for the multicomponent foil type container from FIG. 18.
Figure 21:
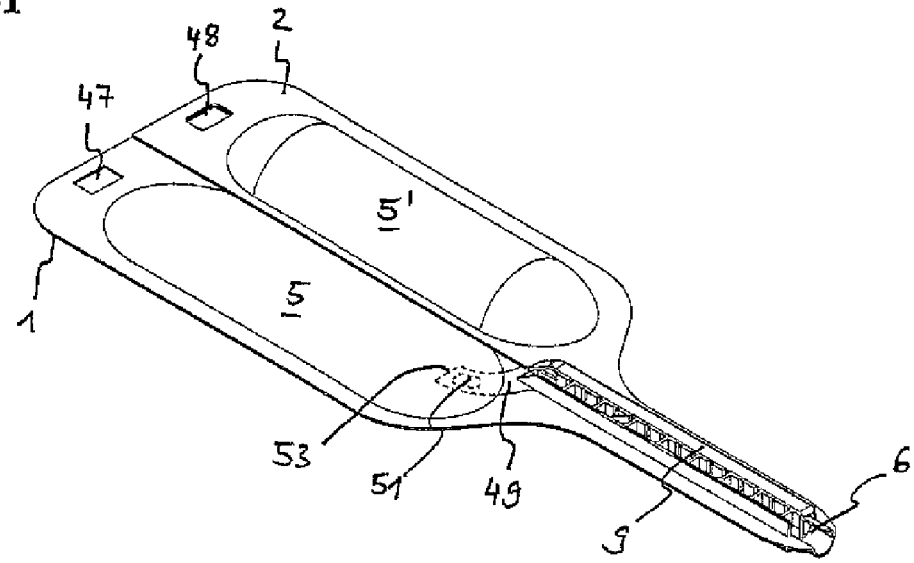
FIG. 21, the partially cutaway multicomponent foil type container with a mixing element from FIG. 18.
Figure 22:
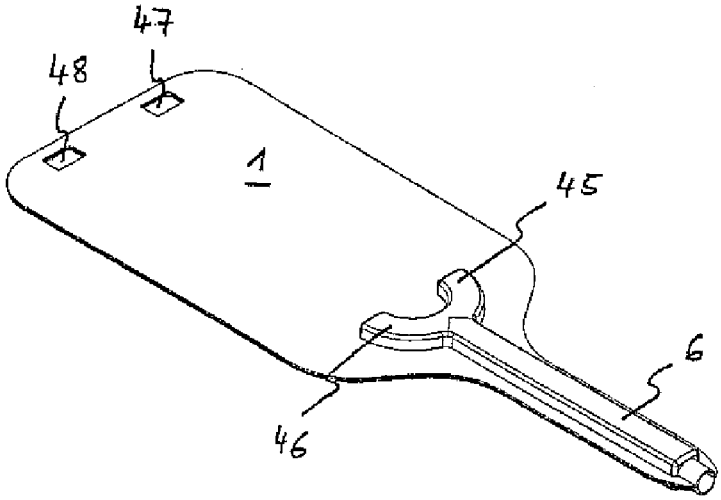
FIG. 22, the bottom side of the multicomponent foil type container from FIG. 18.
Figure 23:
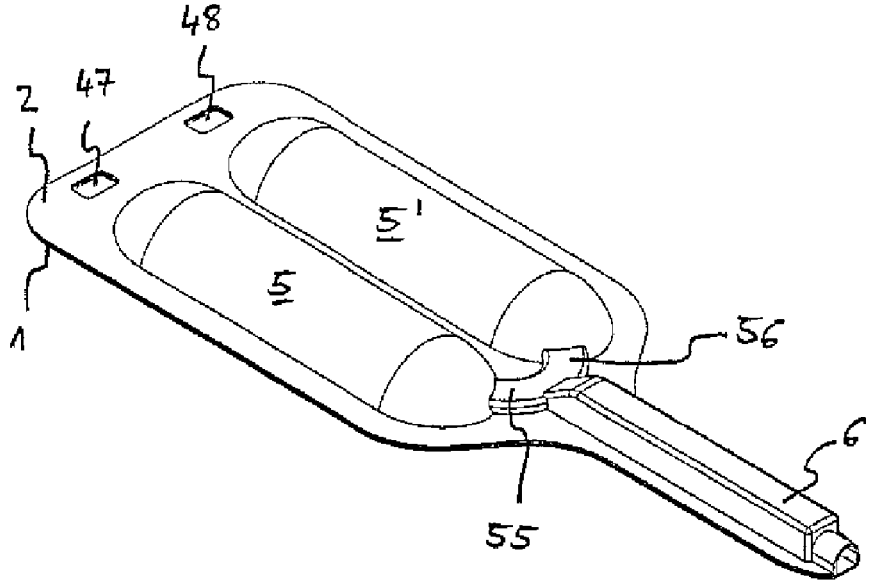
FIG. 23, a ninth embodiment of a multicomponent foil type container.
Figure 24:
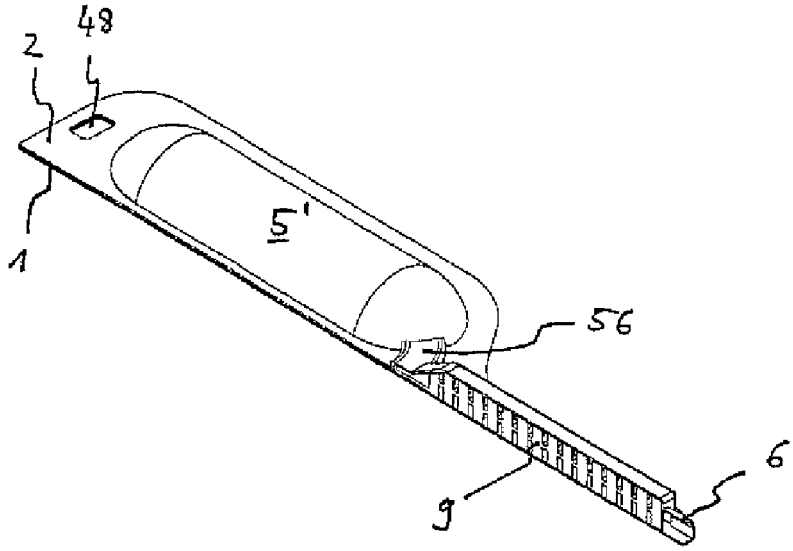
FIG. 24, a longitudinal section through the multicomponent foil type container with a mixing element from FIG. 23.
Figure 25:
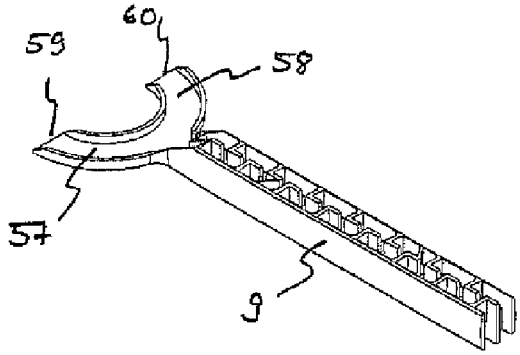
FIG. 25, a mixing element for the multicomponent foil type container from FIG. 23.

In the multicomponent foil type container shown in FIGS. 18 to 22, the discharge duct 6 is formed as a groove-shaped indentation both in the upper upper [sic] second half-shell 2 containing the chambers 5 and 5' and also in the lower first half-shell 1. The half-annular extension of the discharge duct 6 shown in FIG. 22 is formed exclusively in the lower first half-shell 1 and opens with its ends into the chambers 5 and 5', so that connection channels 45 and 46 are formed. The mixing element 9 shown in FIG. 20 is adapted to the shape of the discharge duct 6 and the connection channels 45 and 46 connected to this duct and likewise has a half-annular extension with two guide channels 49 and 50, in which two openings 51 and 52 are formed on its side facing the separating film 12. To open the separating film 12, the discharge duct 6 is bent up and down, so that the edges 53 and 54 used as opening pins in the guide channels 49 and 50 break open the separating film 12. The components can then flow through the openings 51 and 52 into the guide channels 49 and 50 and also the connection channels 45 and 46 and further into the discharge duct 6.

Figure 26:
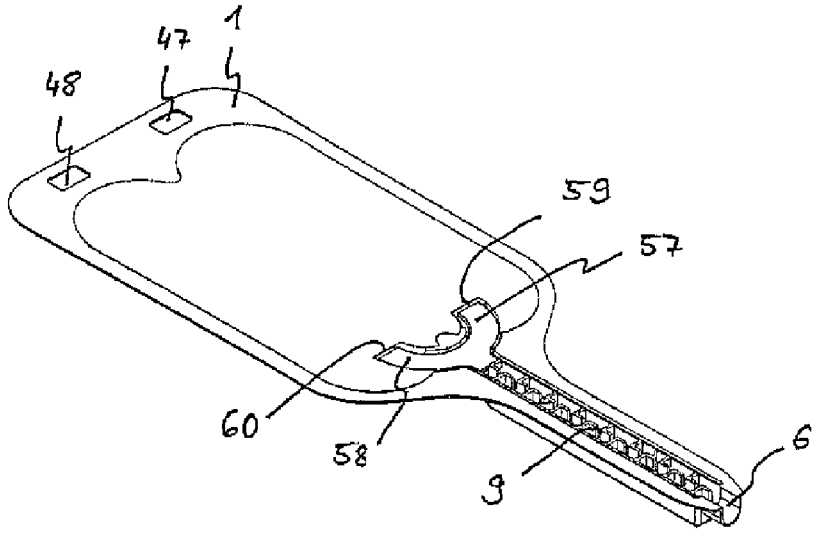
FIG. 26, the bottom side of the partially cutaway multicomponent foil type container with a mixing element from FIG. 23.
Figure 27:
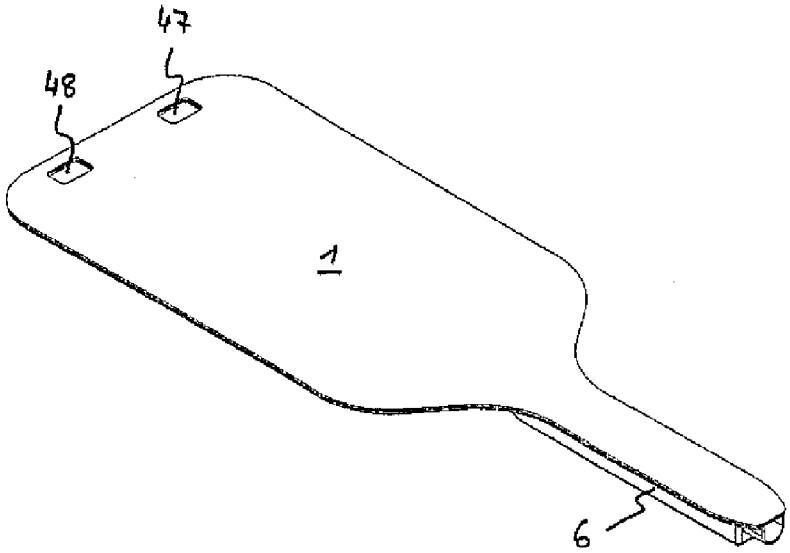
FIG. 27, the bottom side of the multicomponent foil type container from FIG. 23.
Figure 28:
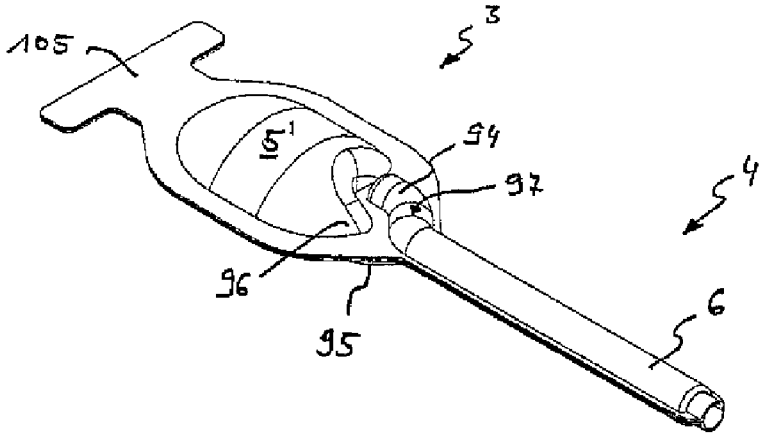
FIG. 28, a tenth embodiment of a multicomponent foil type container.

In FIGS. 23 to 27, another construction of a multicomponent foil type container is shown, which differs from that shown in FIGS. 18 to 22 essentially in that the discharge duct 6 and connection channels 55 and 56 are formed by groove-shaped indentations exclusively in the upper second half-shell 2. The connection channels 55 and 56 are here formed by a half-annular extension of the discharge duct 6 and open with their ends to the chambers 5 and 5' Guide channels 57 and 58 with a shape adapted to the half-annular extension of the discharge duct 6 are arranged, in turn, on the mixing element 9. In addition, the mixing element 9 has a flat bottom side, so that it connects flush with the flat bottom side of the upper second half-shell 2 in the inserted state, as can be seen in FIG. 26. The sealing separating film 12 is attached to the upper second half-shell 2 so that the ends of the guide channels 57 and 58 lie on the outer side of the separating film 12 in the chambers 5 and 5'. Because the chambers 5 and 5', the connection channels 55 and 56, and the discharge duct 6 are formed exclusively in the upper second half-shell 2, the lower first half-shell 1 can be composed of a flat cover film (FIG. 27). In this way, the shaping of both films, which is complicated in terms of production, is avoided, whereby the production of the multicomponent foil type container is simplified. Just as for the construction according to FIGS. 18-22, to open the separating film 12, the discharge duct 6 is bent up and down, so that the edges 59 and 60 of the guide channels 57 and 58 used as opening pins break open the separating film 12. The components can then flow directly through the guide channels 57 and 58 and also the connection channels 55 and 56 into the discharge duct 6.

In FIGS. 28-31, another construction of a multicomponent foil type container is shown, which essentially shows a combination of the multicomponent foil type container with opposing chambers 5, 5' from FIGS. 15 and 17 and the separate guide channels of mixing elements 9 from FIGS. 20-27.

Figure 29:
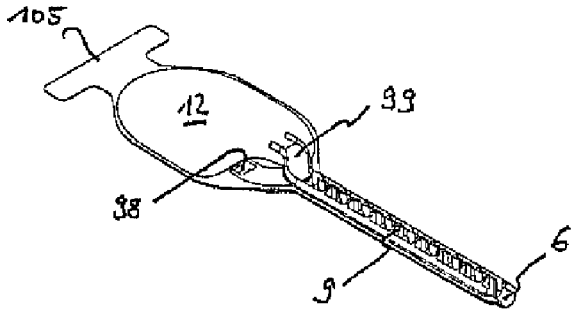
FIG. 29, the bottom side of the partially cutaway multicomponent foil type container with a mixing element from FIG. 28.
Figure 30:
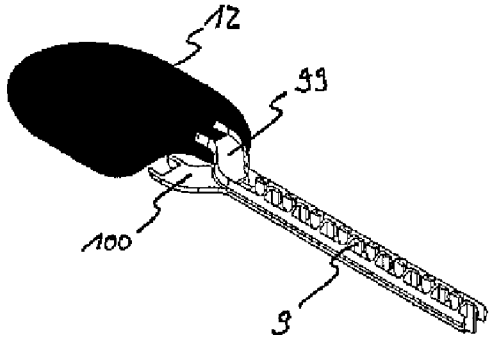
FIG. 30, a view of a separating film and a mixing element of the multicomponent foil type container in FIG. 29.
Figure 31:
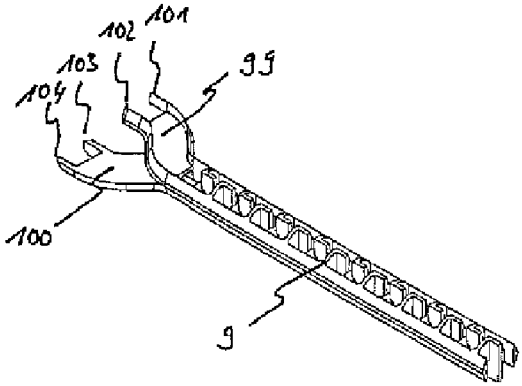
FIG. 31, a mixing element for the multicomponent foil type container from FIG. 28.
Figure 32:
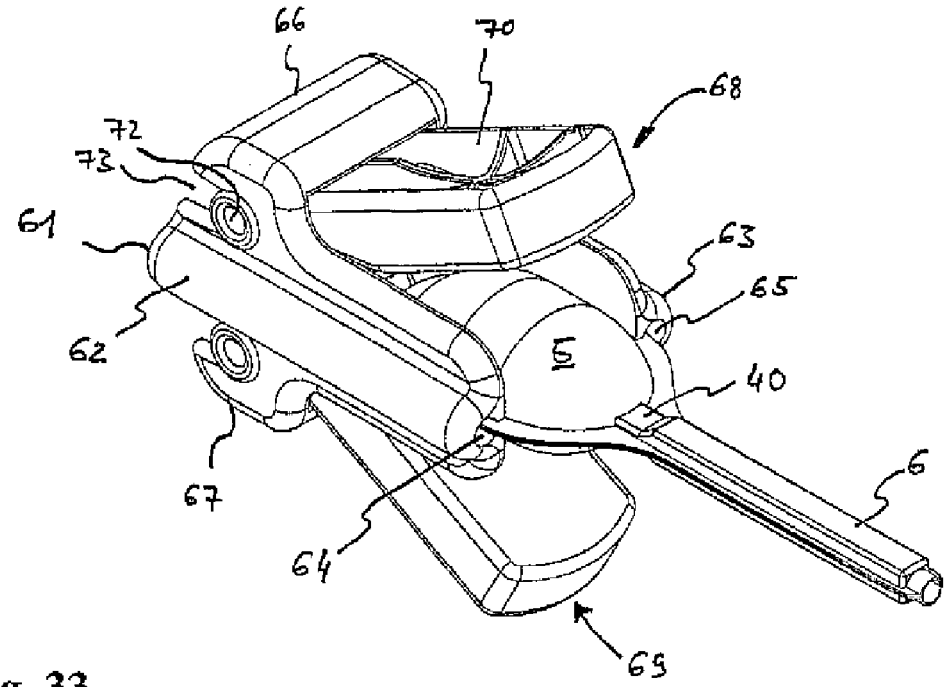
FIG. 32, a first squeezing device for the multicomponent foil type container of the sixth or tenth embodiment from FIG. 15 or 28 with an inserted multicomponent foil type container from FIG. 15.

The multicomponent foil type container according to FIGS. 28-31 has two half-shells 1 and 2, in which a chamber 5 and 5', respectively, and the groove-shaped indentations 94 and 95, respectively, forming the discharge duct 6 are constructed. The groove-shaped indentations 94 and 95 are extended in the shape of an S in the direction of chambers 5 and 5', respectively, which recede towards the back in this area. As emerges from FIG. 28, the S-shaped part of the indentation 94 and an extended area 96 of the chamber 5' are arranged one next to the other such that when the identical half-shells 1 and 2 are placed one on top of the other, the S-shaped indentations 95 and 94, respectively, of one half-shell overlap the extended areas 96 (only shown illustratively in the upper half-shell 2) of the other half-shell. The chambers 5 and 5' are each sealed by its own separating film 12 and 12', respectively, which open the groove-shaped indentations 95 and 94, respectively (FIGS. 29 and 30).

The groove-shaped indentations 94 and 95 each form connection channels 97 and 98, respectively, (in FIG. 29 only shown for the lower half-shell 1) to the discharge duct 6, wherein the mixing element 9 is adapted to the form of the discharge duct 6 and the connection channels 97 and 98. For this purpose, the mixing element 9 has at its rear end two S-shaped guide channels 99 and 100 forming a fork-shaped extension, wherein the upper guide channel 99 in FIG. 31 comes to lie in the connection channel 97 of the upper second half-shell 2 when the multicomponent foil type container is assembled, while the lower guide channel 100 comes to lie in the connection channel 98 of the lower first half-shell 1.

The ends of the guide channels 99 and 100 have crosspieces 101, 102 and 103, 104, respectively, used as opening pins like the mixing element 9 from FIG. 17. To open the separating films 12 and 12', the discharge duct 6 is bent up and down in the area of the S-shaped indentations 95 and 94, respectively, so that the crosspieces 101, 102 of the upper guide channel 99 open the separating film 12 of the lower chamber 5, while the crosspieces 103, 104 of the lower guide channel 100 open the separating film 12' of the upper chamber 5'.

Through subsequent pressing on the chambers 5 and 5', the components can then be led into the discharge duct 6 via the connection channels 97 and 98, respectively, and the guide channels 99 and 100, respectively.

The multicomponent foil type container also has at its rear end a T-shaped extension 105, in order to be able to better grip it by hand or to be able to fix and squeeze it in the squeezing device shown in FIGS. 32-35.

As emerges from the description above, the components can be particularly effectively mixed by the separate mixing element 9 that can be inserted into the discharge duct 6 when the multicomponent foil type container is squeezed. Squeezing is performed by hand or a uniformly homogeneous mixture is obtained by means of the squeezing devices shown in FIGS. 32-38.

The first squeezing device shown in FIGS. 32-35 is used for squeezing a multicomponent foil type container shown in FIG. 15-17 or 28-31 with chambers 5 and 5' lying opposite each other.

The first squeezing device is essentially composed of a holding element 61, in which the multicomponent foil type container from FIGS. 15-17 is pushed forward. For this purpose, the holding element 61 has two side guides 62 and 63 that lie opposite each other and that have circular guide grooves 64 and 65, which are open on the inside and in which the side edges of the multicomponent foil type container can be pushed. To guarantee the spacing of the guides 62 and 63 and also the parallel orientation of the guide grooves 64 and 65, the guides 62 and 63 spread out at their rear end and are there connected to each other by transverse connections 66 and 67, respectively.

Figure 33:
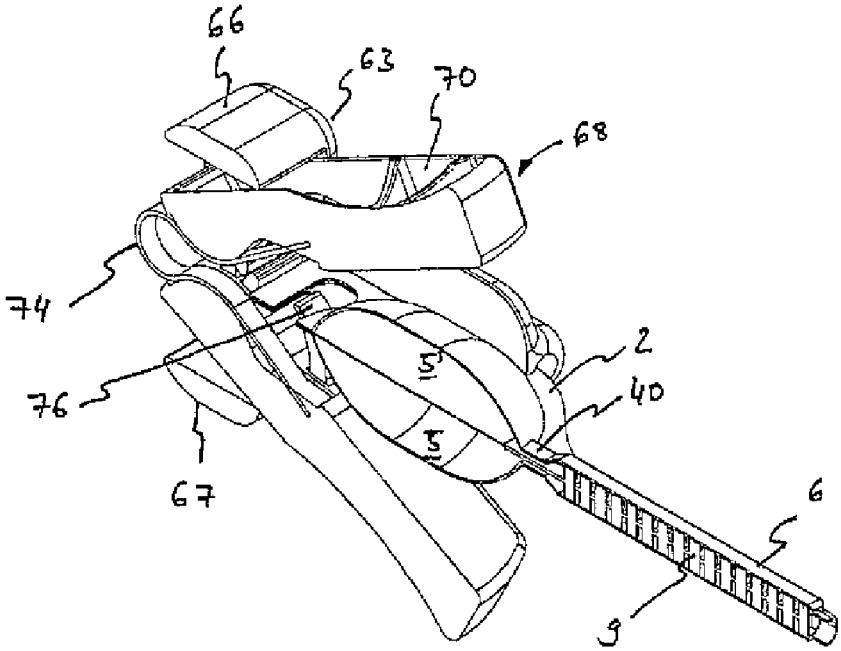
FIG. 33, a longitudinal section through the first squeezing device from FIG. 32.
Figure 34:
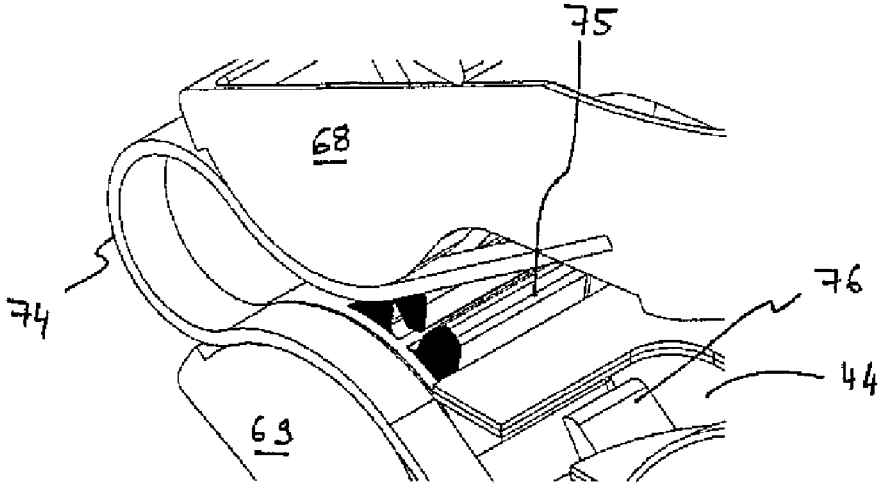
FIG. 34, a detail of the longitudinal section of the view of the squeezing device in FIG. 33.
Figure 35:
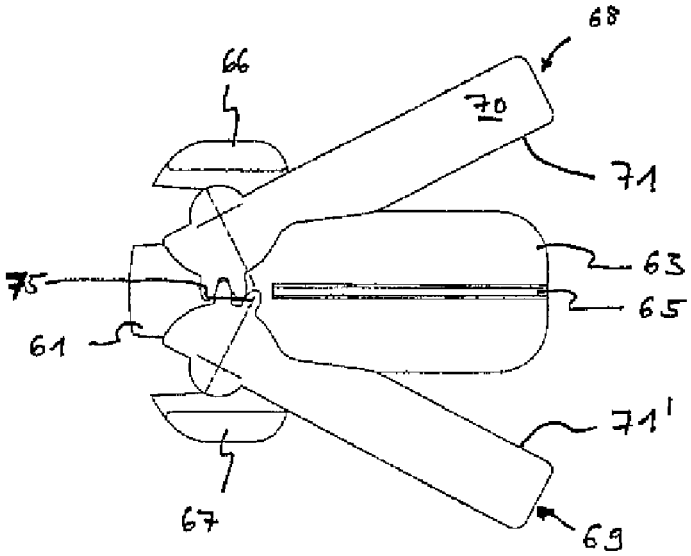
FIG. 35, a schematic longitudinal section through the squeezing device from FIG. 32.

To be able to squeeze the components out of the chambers 5 and 5', two legs 68 and 69 are hinged on the rear end of the guides 62 and 63. Because the legs are identically constructed, only the upper leg 68 is described. The upper leg 68 has an essentially rectangular frame structure 70, which has a squeezing surface 71 on its lower side facing the chamber 5. On the upper side, the frame structure 70 has a small recess. To attach the leg 68 to the holding element 61, it has on its rear end a cylindrical pivot 72, which spreads out at the outer end and which engages in a recess 73 open at the back and constructed as a catch connection in the extension of the guide 62. The bearing of the leg 68 on the second guide 63 is realized in the same way, so that it can rotate about its two pivots and is secured against falling out by being supported on the side guides 62 and 63 of the holding element 61. The second lower leg 69 in FIGS. 32-35 is hinged rotatably on the guides 62 and 63 in an analogous way. To hold the legs 68 and 69 in an open position, a restoring spring 74 shown in detail in FIGS. 33 and 34 is provided, which presses the two legs 68 and 69 apart from each other and against the transverse connections 66 and 67 used as stops. The restoring spring 74 here has the characteristic form shown in FIGS. 33 and 34 and adapted to the squeezing device, in order to allow restoration with little expense, wherein other forms of restoring springs are conceivable without additional means.

To squeeze an inserted multicomponent foil type container, first the separating films 12 and 12' are opened by a single or repeated bending up and down of the discharge duct 6. Then the two legs 68 and 69 of the squeezing device are pressed together with the thumb and index finger, so that the squeezing surfaces 71 and 71' squeeze the components out of the chambers 5 and 5' beginning from the rear end of the multicomponent foil type container. To guarantee a uniform and simultaneous squeezing of both chambers 5 and 5', the legs 68 and 69 each have at the hinged ends two teeth, which are directed towards each other and which form toothing 75, as can be seen especially from FIG. 35. In this way, when pressed together, both legs 68 and 69 remain with their squeezing surfaces 71 and 71' each at the same absolute angle to the chambers 5 and 5', respectively, so that a uniform mixture is performed and consequently a uniformly homogenous mixture can be generated.

To hold the multicomponent foil type container securely in the squeezing device during the squeezing, the lower leg 69 has a holding pin 76 (FIGS. 33 and 34), which points upwards and is curved towards the back and which engages constantly in the opening 44 at the rear end of the multicomponent foil type container during the squeezing. In this way, the multicomponent foil type container is specifically prevented from being pushed forwards out of the squeezing device due to the pressure exerted on the chambers 5 and 5' by the legs 68 and 69.

Figure 36:
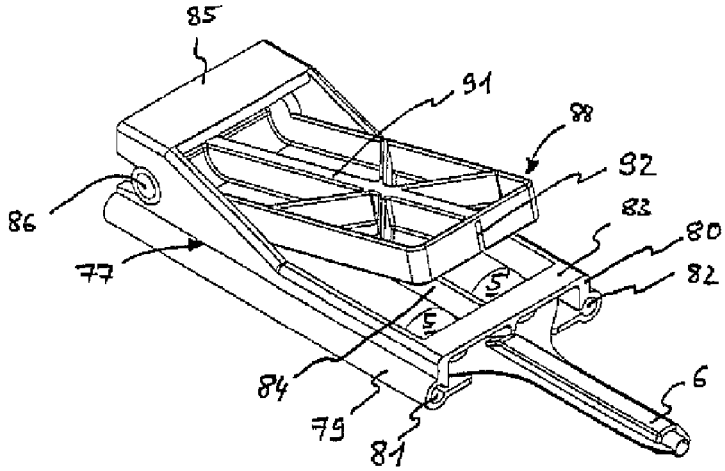
FIG. 36, a second squeezing device for the multicomponent foil type container of the eighth or ninth embodiment from FIG. 18 or 23 with an inserted multicomponent foil type container from FIG. 18.
Figure 37:
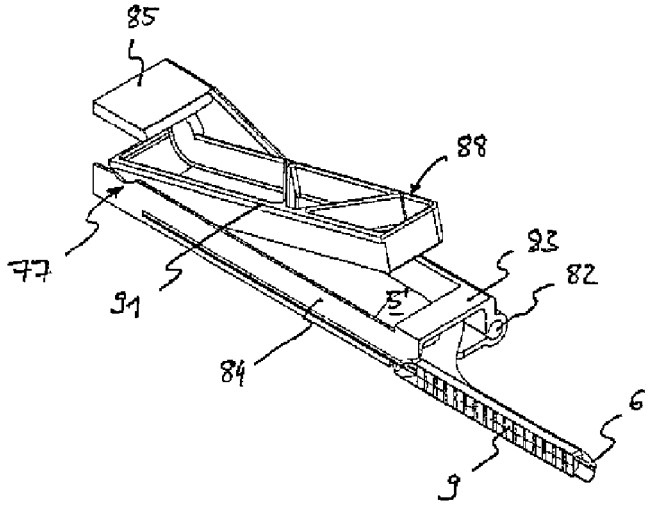
FIG. 37, a longitudinal section through the second squeezing device from FIG. 36.
Figure 38:
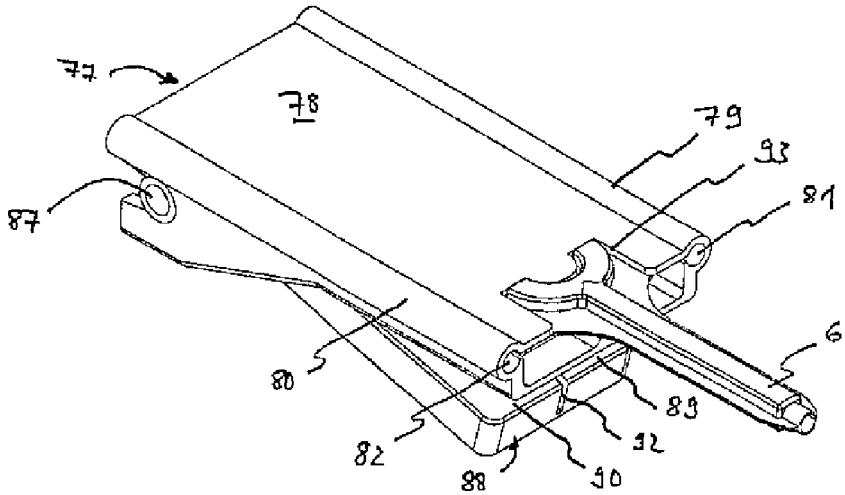
FIG. 38, the bottom side of the second squeezing device from FIG. 36.

The second squeezing device shown in FIGS. 36-38 is used for squeezing a multicomponent foil type container shown in FIGS. 18-27 with chambers 5 and 5' lying one next to the other on the side.

The second squeezing device has a holding element 77, in which the multicomponent foil type container from FIGS. 18-27 is pushed forward. For this purpose, the holding element 77 has a flat base 78 with two opposing side guides 79 and 80 that have circular guide grooves 81 and 82, which are open on the inside and into which the side edges of the multicomponent foil type container can be pushed. The side guides 79 and 80 are connected to each other by a transverse crosspiece 83 at the front end in FIG. 36. As can be seen in FIG. 37, a fixing crosspiece 84, which is fixed at the rear end of the holding element 77, runs from the center of the transverse crosspiece 83 along the longitudinal side of the multicomponent foil type container. The fixing crosspiece 84 reaches into the area between the chambers 5 and 5' of the multicomponent foil type container and represents an additional longitudinal guide. At the rear end of the holding element 77, the guides 79 and 80 spread out in a wedge shape and are connected to each other at their upper ends by means of a transverse connection 85. A leg 88 for squeezing the chambers 5 and 5' is hinged by means of two articulation connections 86 and 87 at the extended sections. The articulation connections 86 and 87 are constructed in the same way as the hinge of the leg 69 on the guides 62 and 63 of the first squeezing device described above.

The leg 88 has a frame structure with two squeezing surfaces 89 and 90, which face the chambers 5 and 5', which are visible in FIG. 38 and which are connected to each other by a wide center crosspiece 91 running longitudinally. The center crosspiece 91 has a longitudinal slot 92, in which the fixing crosspiece 84 is accommodated in the pressed-together state of the second squeezing device.

As can be seen from FIG. 38, the base 78 of the holding element 77 has a recess 93, which is adapted to the semicircular extension of the discharge duct 6 in the lower first half-shell 1 of the embodiment of the multicomponent foil type container shown in FIGS. 18-22, at its end facing the discharge duct of the multicomponent foil type container and at the front in FIG. 38. In this way, an additional center fixing and also a stop for the inserted multicomponent foil type container is provided.

For squeezing a multicomponent foil type container inserted into the second squeezing device, the leg 88 is pressed, for example, with the thumb, against the holding element 77, so that the squeezing surfaces 89 and 90 squeeze the components out of the chambers 5 and 5' beginning from the rear end of the multicomponent foil type container. In this way, a uniform and simultaneous squeezing of the components from the chambers 5 and 5' is reliably performed, so that toothing like that in the first squeezing device is unnecessary.

The second squeezing device of FIGS. 36-38 also has a restoring spring that cannot be seen in the drawings, in order to hold the leg 88 in an open position before inserting the multicomponent foil type container, wherein the transverse connection 85 is also used here as a stop for the leg 88. To be able to fix the multicomponent foil type container during the squeezing, the leg 88 has two holding pins, which are not visible in the drawings and which engage in the openings 47 and 48 of the embodiment of the multicomponent foil type container shown in FIGS. 18-27 during the squeezing process, at its hinged end on its lower side. In this way, undesired slipping of the multi-component foil type container from the second squeezing device is prevented.

The invention is not limited to the constructions shown here. For example, the squeezing device can have clamping means at the rear end, in order to reliably fix the rear end of the multicomponent foil type container in the squeezing device during the squeezing process.

The invention claimed is:

1. Multicomponent foil container comprising an elongated foil structure defining a first chamber (5) for accommodating a first component, and defining at least one second chamber (5') for accommodating a second component, said foil structure further defining at one end thereof an elongated discharge duct (6) connected at one end to the chambers (5, 5'), and at its other end defining an outlet, at least one seal (12; 12; 21; 25, 25; 36, 36') that prevents mixing of the components in the first and second chambers before use and that can be opened for discharging the components, a separate mixing element (9) freely arranged non-rotationally in the discharge duct (6) with the end of the mixing element (9) facing the chambers (5, 5') being elongated toward the chambers (5, 5'), said mixing element including a plurality of longitudinally spaced deflection elements defining a tortuous path through the mixing element, and at least one opening pin (42, 43; 53, 54; 59, 60; 101, 102, 103, 104) for opening the at least one seal (12, 12; 12; 12; 12, 12') mounted on said end of the mixing element elongated toward the chambers.

2. Multicomponent foil container according to claim 1, characterized in that the chambers (5, 5') are shaped as two half-shells (1, 2).

3. Multicomponent foil container according to claim 1, characterized in that the at least one seal (12; 12; 21; 25, 25; 36, 36') is formed by at least one separating film (12; 12') arranged between the chambers (5, 5') and/or by separating walls (21; 25, 25; 36, 36') for separating the chambers (5, 5') from the discharge duct (6).

4. Multicomponent type container according to claim 1, characterized in that the mixing element (9) is composed of a dimensionally stable base body (10), which is provided with openings (33) and on which the deflection elements (11) are formed.

5. Multicomponent foil container according to claim 1, characterized in that the discharge duct (6) is formed by two groove-shaped indentations (7, 7') in the foil structure.

6. Multicomponent foil container according to claim 5, characterized in that separating crosspieces (8, 8') are provided in the foil structure between the chambers (5, 5') and the grove-shaped indentations (7, 7').

7. Multicomponent foil container according to claim 6, characterized in that the at least one seal (12) is connected detachably to at least one of the chambers at least in the area of the separating crosspieces (8, 8') for connecting the chambers (5, 5') to the discharge duct (6).

8. Multicomponent foil container according to claim 5, characterized in that the groove-shaped indentations (7, 7') have elongated, inclined parts (15, 15') on their ends adjacent the chambers, which are arranged next to an area (16, 16') of the chambers (5, 5') elongated towards the discharge duct.

9. Multicomponent foil container according to claim 8, characterized in that opening pins (17', 17) lie on their said ends of said inclined parts pointed toward the at least one seal that can be pressed from the outside.

10. Multicomponent foil container according to claim 1, characterized in that the chambers (5, 5') are arranged in a storage part (19; 24) of the foil structure and the discharge duct (6) is mounted to the storage part (19; 24) of the foil structure.

11. Multicomponent foil container according to claim 1, characterized in that the mixing element (9) is movable in the discharge duct (6) for causing the opening pin to puncture the one or more seals (12; 21; 25, 25; 36, 36').

12. Multicomponent foil container according to claim 11, characterized in that at least one opening pin (13, 22) is arranged on the end of the mixing element (9) facing the chambers (5, 5') in juxtaposition to the at least one seal (12; 21; 25, 25; 36, 36').

13. Multicomponent foil container according to claim 12, characterized in that a plunger (14) having a weakened point for breaking off is attached to the end of the mixing element (9) remote from the opening pin (13; 22).

14. Multicomponent foil type container according to claim 1, characterized in that the mixing tube (23) is arranged movable in the axial longitudinal direction relative to the storage part (24).

15. Multicomponent foil container according to claim 14, characterized in that the mixing element (9) has a catch connection or clamping means (34, 35) for holding within the mixing tube (23).

16. Multicomponent foil container according to claim 1, characterized in that the end of the mixing element (9) facing the chambers (5, 5') has at least one guide channel (41; 49, 50; 57, 58; 99, 100), in order to guide the components from the chambers (5, 5') into the discharge duct (6) after the at least one seal (12, 12; 12; 12; 12, 12') is opened.

17. Multicomponent foil container according to claim 1, characterized in that the at least one seal (12; 12') can be destroyed by bending the discharge duct (6) to cause an end of the freely arranged mixing element to move sufficiently to puncture the at least one seal.

18. Multicomponent foil container according to claim 1, characterized in that at least one opening (44; 47, 48; 47, 48) is defined in the container for fixing in a squeezing device on the end facing away from the discharge duct (6).

19. Multicomponent foil container according to claim 1, characterized in that the chambers (5, 5') are each formed in the foil structure as half-shells (1, 2) facing each other and are each sealed by a separating film (12, 12'), wherein a guide channel (41) of mixing element (9) is inserted into the discharge duct (6) and projects into the chambers (5, 5') between the two separating films (12, 12').

20. Multicomponent foil container according to claim 19, characterized in that at least one opening pin is formed by a side crosspiece (42, 43) on guide channel (41) of the mixing element (9).

21. Multicomponent foil container according to claim 1, characterized in that the chambers (5, 5') are formed in a common part of the foil structure and are sealed by a separating film (12) and wherein the discharge duct (6) has two connection channels (45, 46; 55, 56) one to each of the chambers (5, 5').

22. Multicomponent foil container according to claim 21, characterized in that the elongated end of the mixing element (9) is adapted to the shape of the connection channels (45, 46; 55, 56) and includes a separate guide channel (49, 50; 57, 58) provided with an opening pin (53, 54; 59, 60) for each chamber (5, 5').

23. Multicomponent foil container according to claim 22 characterized in that the guide channels (49, 50; 57, 58) of the mixing element (9) inserted into the discharge duct (6) project into the chambers (5, 5').

24. Multicomponent foil container according to claim 21, characterized in that the connection channels (45, 46) are formed by groove-shaped indentations in the common part of the foil structure.

25. Multicomponent foil container according to claim 21, characterized in that the discharge duct (6) and the connection channels (55, 56) are formed by groove-shaped indentations in a.

26. Multicomponent foil container according to claim 1, characterized in that the chambers (5, 5') are each formed as a half-shell (1, 2) in the foil structure and are each sealed by a separating film (12, 12') and discharge duct (6) has, on the end adjacent the chambers, connection channels (97, 98), which are arranged next to an area (96) of the chambers (5, 5') extended towards the front.

27. Multicomponent foil container according to claim 26, characterized in that the mixing element (9) has an extended end that is adapted to the shape of the connection channels (97, 98) and which defines a separate guide channel (99, 100) with opening pins (101, 102; 103, 104) for each chamber (5, 5').

28. Multicomponent foil type container according to claim 26, characterized in that one connection channel (98) formed in the foil structure extends via the area (96) of the upper chamber (5') extended towards the front and formed in the foil structure and the upper connection channel (97) formed in the foil structure extends via the area of the lower chamber (5) extended towards the front and formed in the foil structure.

29. Multicomponent foil container according to claim 26, characterized in that it has a T-shaped extension (105) for fixing in a squeezing device on its end facing away from the discharge duct (6).

30. Container arrangement, characterized in that several multicomponent foil containers according to claim 1 are connected to each other by means of connection points (39) at their side edges.

31. Container arrangement according to claim 30, characterized in that the connection points (39) are constructed as desired rupture points.

32. A kit comprising a multicomponent foil container according to claim 1 and a squeezing device for holding the multicomponent foil container while being squeezed, said squeezing device having two elongated members hinged together and including a holding element (61; 77) and side guides (62, 63; 79, 80), wherein a multicomponent foil container can be positioned on at least one of said elongated members between said side guides and held by said holding element (61; 77) and wherein said elongated members can move relatively towards the chambers (5, 5') of the multicomponent foil container for squeezing the first and second components out of the chambers (5,5') of the multicomponent foil container.

33. A kit according to claim 32, wherein the squeezing device further includes a restoring spring (74), for biasing said elongated members into an open position.

34. A kit according to claim 32, wherein the holding element of the squeezing device comprising at least one holding pin (76) for engaging and holding the multicomponent foil container during the squeezing process.

35. A kit according to claim 32 wherein the two elongated members are hinged juxtaposed to the holding element (61).

36. A kit according to claim 35, wherein the squeezing device includes intermeshing toothing (75), to control squeezing of the two chambers (5, 5') of the multicomponent foil container.

37. A kit according to claim 32 wherein the holding element (77) is is complementary in shape to connection channels (45, 46; 55, 56) of the multicomponent foil container.

38. Multicomponent foil container comprising:

A. a first elongated foil having a longitudinal axis and a proximal end and a distal end and being deformed to define (a) a first chamber extending on opposite sides of the longitudinal axis having a first portion laterally spaced to one side of the longitudinal axis of the foil and projecting toward the distal end of the foil in which a first component is received, and (b) a first duct laterally spaced from the first portion to the other side of the longitudinal axis and extending forwardly toward the distal end of the foil;

B. a first seal sealing the first chamber;

C. a second elongated foil having a longitudinal axis and a proximal end and a distal end and being deformed to define (a) a second chamber extending on opposite sides of the longitudinal axis having a second portion laterally spaced to the opposite side of the longitudinal axis of the foil and projecting toward the distal end of the foil in which a second component is received, and (b) a second duct laterally spaced from the second portion on the opposite side of the longitudinal axis and extending forwardly toward the distal end of the foil;

D. a second seal sealing the second chamber whereby said first and second seals prevent mixing of the components before use;

E. the distal end of each foil defining an elongated housing portion the proximal end of which is in communication with at least one of the first and second ducts;

F. said foils being bonded together to define a planar container with the seals juxtaposed to one another and the elongated housing portions sealed together to define an elongated discharge duct coupled at its proximal end to the first and second ducts and having a discharge at its distal end;

G. a separate elongated mixing member having a proximal end juxtaposed to the first and second ducts and a spout at its distal end that includes deflection elements for mixing components, said mixing member being received within the discharge duct, the proximal end of said mixing member having at least two grooved channels extending proximally that lie in the first and second ducts with the ends of the grooved channels each defining a sharp point that lies juxtaposed to a seal;

H. whereby in use motion of the discharge duct and mixing member normal to the planar container causes the sharp points of the grooved channels to rupture the first and second seals whereupon the first and second chambers of the foil container can be squeezed to cause the components contained therein to flow out the ruptured seals via said grooved channels into the first and second ducts and into the proximal end of the discharge duct and be mixed by the deflection elements as they are forced to flow through the discharge duct and thus will emerge as a mixed discharge at the distal end of the discharge duct.

39. Multicomponent foil container comprising:

A. a pair of elongated foils each having a longitudinal axis and being deformed to define (i) a component chamber extending across the longitudinal axis with a projecting portion thereof laterally spaced to one side of the longitudinal axis of the foil and projecting toward one end of the foil, and (ii) a component outflow duct laterally spaced from the projecting portion to the other side of the longitudinal axis and extending forwardly toward the one end of the foil;

B. component materials to be mixed contained in the component chambers;

C. a seal sealing each chamber to prevent mixing of the components before use;

D. said foils being bonded together to define a planar container with the seals juxtaposed to one another and the projecting portions lying on opposite sides of the longitudinal axis;

E. an elongated discharge duct coupled at one end to the component outflow ducts and having a discharge at its other end;

F. a separate elongated mixing member received within the discharge duct juxtaposed at one end to the component outflow ducts, said mixing member having deflection elements for mixing components, and having two grooved channels lying in the component outflow ducts with the ends of the grooved channels each defining a sharp point lying juxtaposed to a seal;

G. whereby in use motion of the discharge duct and mixing member normal to the planar container causes the sharp points of the grooved channels to rupture the seals whereupon the component chambers of the foil container can be squeezed to cause the component materials contained therein to flow out the ruptured seals via said grooved channels into the component outflow ducts and into the one end of the discharge duct and be mixed by the deflection elements as they are forced to flow through the discharge duct and be discharged as mixed component materials at the other end of the discharge duct.

* * * * *